United States Patent [19]

Blanchard

[11] Patent Number: 5,022,571

[45] Date of Patent: Jun. 11, 1991

[54] INTERNAL GARMENT HANGER WITH TENSIONING SPRINGS AND STRAPS

[75] Inventor: Russell O. Blanchard, Zeeland, Mich.

[73] Assignee: Batts, Inc., Zeeland, Mich.

[21] Appl. No.: 446,049

[22] Filed: Dec. 5, 1989

[51] Int. Cl.[5] ..... A47G 25/48; A47G 25/62; A47G 25/14; A47G 25/44

[52] U.S. Cl. ..... 223/95; 223/89; 223/85

[58] Field of Search ..... 223/85, 88, 89, 94, 223/95, 96; 211/113; D6/315, 326

[56] References Cited

U.S. PATENT DOCUMENTS

| | | | |
|---|---|---|---|
| 2,418,106 | 3/1947 | Zimmermann | 223/95 |
| 3,457,581 | 7/1969 | Oas . | |
| 3,710,996 | 1/1973 | Smilow et al. . | |
| 4,063,669 | 12/1977 | Smilow et al. . | |
| 4,416,401 | 11/1983 | King . | |
| 4,618,080 | 10/1986 | Shalson . | |
| 4,729,498 | 3/1988 | Blanchard . | |
| 4,793,531 | 12/1988 | Blanchard et al. . | |

FOREIGN PATENT DOCUMENTS

| | | | |
|---|---|---|---|
| 3426593 | 7/1984 | Fed. Rep. of Germany | 223/85 |

OTHER PUBLICATIONS 0,346,780 A2, Eurpean Patent Office Application, 10--6-89, Weihrauch.

Advertising material by Poly-Flex, Inc. entitled, "Poly-Cord".

Shell Chemical Company brochure entitled, "Kraton Thermoplastic Rubber—Typical Properties 1987".

Catalog material entitled, "Shell Kraton Polymers for Modification of Thermoplastics"—1987.

*Primary Examiner*—Werner H. Schroeder

*Assistant Examiner*—Bibhu Mohanty

*Attorney, Agent, or Firm*—Price, Heneveld, Cooper, DeWitt & Litton

[57] ABSTRACT

An internal garment hanger adapted to support a garment from an inner surface of a waistband includes an elongated body defining open ends and longitudinally extending slots. A pair of elongated slides are provided which telescope into the ends of the body. Each slide includes an outer end configured to engage the garment. An elastomeric member or spring has an end fixed to the slide and an end fixed to hanger body. The member or spring resiliently biases the slide out of the open end of the body and into gripping engagement with the garment. Each slide defines a stop which limits outward movement of the slide with respect to the body. In the preferred form, the elastomeric member is molded and bonded to the slide in the manufacturing process.

21 Claims, 2 Drawing Sheets

INTERNAL GARMENT HANGER WITH TENSIONING SPRINGS AND STRAPS

BACKGROUND OF THE INVENTION

The present invention relates to garment hangers and more particularly to hangers which are adapted to engage the inside surface of the waistband of a garment.

Heretofore, a wide variety of skirt, pants, and slack hanger have been proposed. Some of these hangers employ a pair of clamps joined to or mounted on a main hanger body. The clamps engage outer surfaces of the garment at the waistband. Another form of garment hanger is of the internal type which is adapted to engage an inner surface of the waistband of the garment. The majority of an internal hanger is covered by the garment when in use. The hanger will not, therefore, detract from the visual appearance of the garment.

Internal garment hangers have suffered from various problems or shortcomings. Generally, such hangers must be capable of supporting the garment not only for display purposes but also for shipment purposes. When the garment is shipped on the hanger, it may be readily positioned on the rack for display purposes at the retail level. An example of a prior internal garment hanger may be found in commonly owned U.S. Pat. No. 4,729,498 entitled TELESCOPIC GARMENT HANGER and issued on Mar. 8, 1988 to Blanchard. The hanger shown therein includes a main body member supported at its center by a suspension hook and a pair of end slides which are telescopingly received within the main body member. The slides are biased to an outward, garment engaging position by an elastic band. Ends of the band are received in seats defined by bosses formed on the main body. Each band is looped around an inner end of the slide member. Vertically extending hand grips are provided for moving the slides inwardly against the resilient bias of the bands Attempts to provide sufficient engagement forces have resulted in bulky hangers, hangers which are difficult to apply to or remove from the garment and hangers which are difficult to manufacture and/or assemble. Problems have been presented with providing such hangers with a self-centering capability. It is desirable that the hanger center itself with respect to the garment so that the suspension hook is not off center and the hanger will support the garment in a straight position.

A need exists for an internal garment hanger which possesses increased ease of manufacture and assembly, which will readily support a wide variety of garments for display and transport purposes and which may be easily used.

SUMMARY OF THE INVENTION

In accordance with the present invention, the aforementioned needs are substantially met. Essentially, a garment hanger is provided which includes an elongated body defining open ends and a longitudinally extending slot which opens through the front and rear faces of the body. A pair of elongated slides are telescopingly positioned in the ends of the body. Each slide defines an outer surface configured to engage a garment at an inner surface of a waistband. Provision is made for resiliently biasing each slide out of the hanger body and into engagement with the garment.

In narrower aspects of the invention, each slide includes an end ring defining a finger or thumb aperture which is readily grasped through the slot of the main body. The slides may be moved inwardly in a one-handed operation. In the preferred form, an elastomeric strap has an end permanently bonded to the slide and another end permanently bonded to an end cap. The slides are readily assembled by merely inserting their ends into the main garment body.

DETAILED DESCRIPTION OF THE PREFERRED EMBODIMENT

Figure 1:
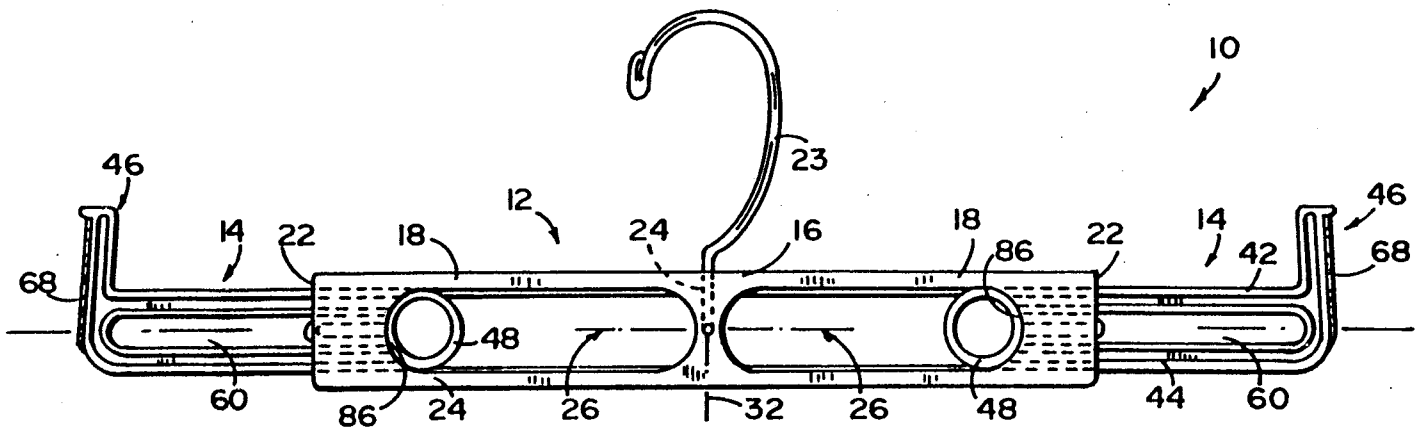
FIG. 1 is a front, elevational view of a garment hanger in accordance with the present invention.

An internal garment hanger in accordance with the present invention is illustrated in FIG. 1 and generally designated by the numeral 10. Hanger 10 includes a main body 12 and a pair of end members or slides 14. End members 14 are identical. Body 12 includes a center portion 16, outwardly extending arms 18 and ends 22. A suitable suspension hook 23 supports body 12. In the form illustrated, hook 23 is a metal hook received within a vertical bore 24 formed in center portion 16. In the alternative, hook 23 could be a hook molded as part of main body 12.

Main body 12 is an elongated, generally rectangular member having a thin tubular configuration with ends 22 being open. Front and back sidewalls 24, 25 of body 12 are formed with elongated, juxtaposed slots 26. Main body 12 defines upper and lower beam-like members 28, 30. Body 12 is symmetrical about a vertical centerline 32. Body 12 is molded from a suitable plastic.

Figure 5:
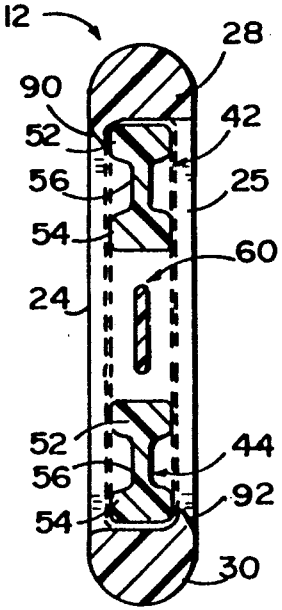
FIG. 5 is a cross sectional view taken along line V—V of FIG. 4.
Figure 2:
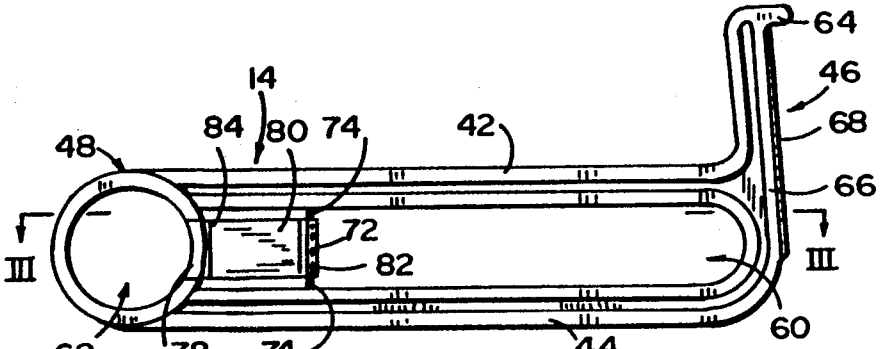
FIG. 2 is a front, elevational view of a slide element in accordance with the present invention.
Figure 3:
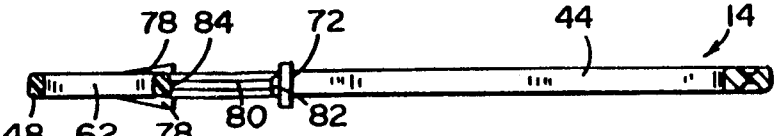
FIG. 3 is a cross sectional view taken along line III—III of FIG. 2.

As seen in FIGS. 1, 2 and 3, each end member 14 has an elongated, generally rectangular configuration and includes an upper beam 42, a lower beam 44, a garment engaging portion or outer end 46 and an inner end 48. Beams 42, 44 as seen in FIG. 5 have a generally I-beam configuration including upper and lower flanges 52, 54 joined by a vertical web 56. Member 14 further defines an elongated, open slot 60. End 48 defines a ring having an aperture 62. Outer end portion 46 includes a garment stop 64 and an outer surface 66. A pad 68 is joined to outer surface 66.

During the manufacturing process, an end cap or stop 72 is joined to beams 42, 44 within slot 60 by narrow bridges 74. Cap 72 extends transversely to beams 42, 44 as shown in FIG. 3. Slide 14 further includes stops 78 extending outwardly from each front and rear face of member 14. An elastic member, resilient means or spring 80 extends between cap 72 and end 48. In the presently preferred form, means 80 is an elastomeric strap having an end 82 permanently bonded to cap 72 and an end 84 permanently bonded to end 48 of slide 14. The slide, the cap and the strap form an integral, unitary element or component.

In the manufacture of slide 14, a two-piece mold is provided with a cavity which simultaneously forms the beams 42, 44 and ends 46, 48 and the cap 72. A mold cavity is provided with a cam positioned between cap 72 and end 48 in the space where strap 80 will be formed. Another cam is in the space where pad 68 will be formed. With cams in the cavity, a suitable resin such as polypropylene or styrene is injected into the mold. The material fills the entire mold except the spaces occupied by the cams. Within several seconds after filling of the mold cavity, the resin will have set sufficiently so that the cams occupying the spaces for the strap and pad may be withdrawn. Immediately thereafter, the resin used to form the elastomeric strap 80 and pad 68 is injected under pressure and heat into the strap cavity and pad cavity. The mold is held closed until both of the injected resins have set sufficiently that the molded member 14 can be removed without distortion or loss of geometric integrity. The process integrally forms member 14, stop or cap 72, bridges 74 and strap 80.

It is presently preferred that slide 14 and cap 72 be molded from styrene. When formed from styrene, strap 80 is molded from a thermoplastic rubber manufactured and sold by Shell Oil Company under the name Kraton D-2104. This thermoplastic rubber forms a bond between the styrene of the slide body and the cap. It is believed that the bond is formed by a molecularly interlocking polymer network. The materials are permanently joined in a two shot molding process without the use of adhesives or mechanical interconnection. Separation problems are eliminated. Kraton thermoplastic rubber has a molecular structure of block segments of styrene monomer units and rubber monomer units. The most common structure is a linear A-B-A block type: styrene-butadiene-styrene and styrene-isoprene-styrene. Kraton rubber is supplied in many grades. For the present application, Kraton D-2104 is preferred. Kraton D-2104 has the following properties:

| | |
|---|---|
| Hardness, Shore A (D-2240) | 70 |
| Tensile Properties (D-412) | 4300 |
| Tensile Strength, psi | |
| 300% Modulus, psi | 400 |
| Elongation, % | 880 |
| Specific Gravity | 0.94 |
| Melt Index - Condition G, gms/10 min. | 15 |

Pad 68 may be formed from Kraton D-2104 rubber. In the alternative, different grades such as Kraton D-3226 or D-2109 may be used to form the pad when the slide is molded from styrene. If the slide is molded from polypropylene, a Kraton G series rubber is used for strap 80 and pad 68. The G series is a polymer of styrene-ethylene/butylene-styrene type and bonds with polypropylene.

Body 12 is molded from a suitable resin such as a polypropylene or a styrene. Slides 14 are assembled to hanger body 12 by inserting ends 48 through open ends 22. Sidewalls 24, 25 of the hanger body flex or expand slightly due to ramping action of stops 78 allowing the stops to pass into the ends. When in the position shown in FIG. 1, end cap 72 engages both sides of end portion 22. Cap 72 is dimensioned to be retained by body 12. Further inward movement of slide 14 shears bridges 74. Stops 78 engage edges 86 of slots 26. Further outward movement of member 14 is prevented. Stops 78 each slope outwardly from end 48 and define shoulders engaging the ends of the hanger body. Hanger body 12 includes guides 90, 92 (FIG. 5). The guides are provided on opposite surfaces and engage beam portion 52 and beam portion 54 of the beams 42, 44, respectively. Guides 90, 92 provide stability and guide members 14 as they move within the open slots 26.

Figure 4:
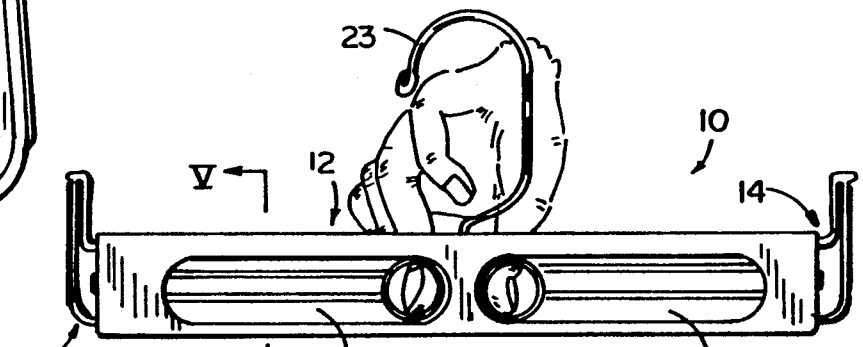
FIG. 4 is a front, elevational view of the hanger with the slides retracted.

As seen in FIG. 4, the user grasps the slides 14 at ring apertures 62 employing one hand. The ends of slides 14 move towards each other against the resilient bias of the 15 elastomeric straps or resilient biasing means 80. The user may readily insert the hanger within the interior of a garment waistband. Stops 64 on end portions 46 limit downward movement of the hanger with respect to the garment by engaging a top outer surface of the waistband.

The slide embodiment of FIGS. 2 and 3 is presently preferred. The structure eliminates prior assembly steps since the resilient biasing means is manufactured integral with the slide. Assembly is greatly simplified. Other alternatives having some of the assembly advantages may, however, be used. Various alternatives for the resilient biasing means 80 are illustrated in FIGS. 6–10.

Figure 6:
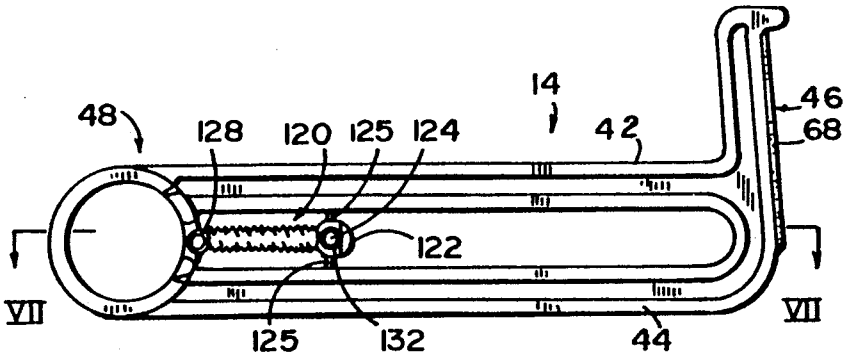
FIG. 6 is a front, elevational view of an alternative slide element.
Figure 7:
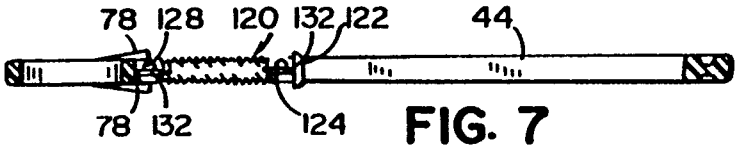
FIG. 7 is a cross sectional view taken along line VII—VII of FIG. 6.

In the embodiment of FIGS. 6 and 7, a coil spring 120 is used. A cap 122 which defines a post or boss 124 is joined to beams 42, 44 by bridges 125. End portion 48 of member 14 defines another post or boss 128. Coil spring 120 includes loop ends 132 which are positioned over the posts. After members 14 are removed from the mold during the manufacturing process, springs 120 are positioned on the members 14 by inserting the looped ends over the respective posts. The slides 14 are then inserted into the ends of hanger body 12 as with the prior embodiment. Bridges 1 25 are sheared and caps 122 are retained in the ends of the hanger. The slides are easily assembled to body 12. However, an extra assembly step is required when compared to the embodiments of FIGS. 2 and 3.

Figure 8:
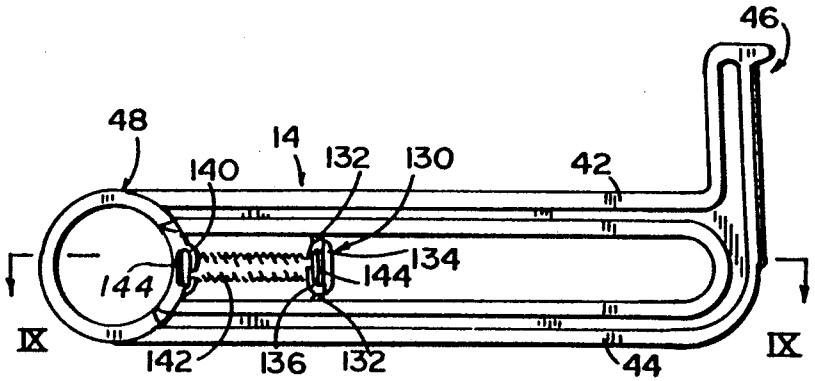
FIG. 8 is a front, elevational view of another alternative embodiment of the slide element.
Figure 9:
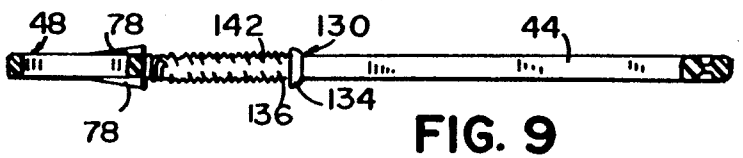
FIG. 9 is a cross sectional view taken along line IX—IX of FIG. 8.

In the embodiment of FIGS. 8 and 9, a cap or stop 130 is molded and joined to the beam portions of slide 14 by bridges 132. Cap 130 includes an end flange portion 134 and a loop 136. End portion 48 of slide 14 is formed with a similar loop 140. A coil spring 142 has transversely positioned looped ends 144. The looped ends are received within the slots defined by the loops 136, 140.

Figure 10:
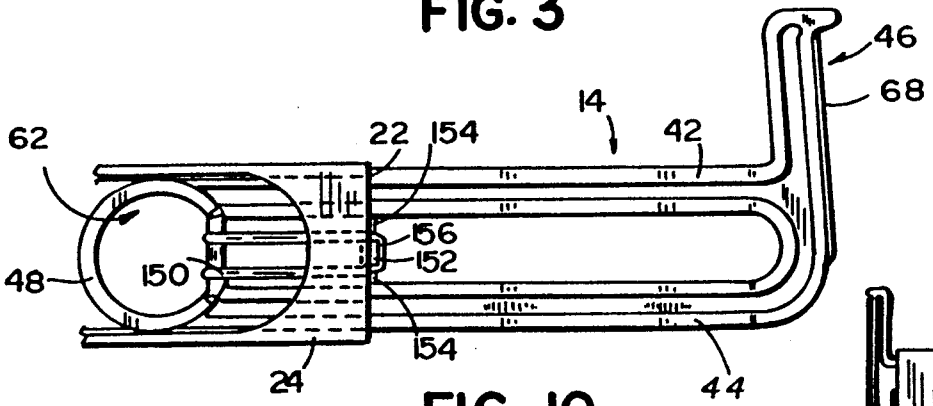
FIG. 10 is a fragmentary, front elevational view of a still further alternative embodiment.

In the embodiment illustrated in FIG. 10, an elastic or rubber band 150 is used. A cap 152 is molded to slide 14 by bridges 154. An end 156 of band 150 is looped around cap 152. The other end is passed through aperture 62 of slide 14 and looped on the opposite side of cap 152. Slide 14 is then inserted into an open end 22 of hanger body 12. Bridges 154 are sheared when the slide is pushed into body 12.

In each of the embodiments, the caps are formed with the slides 14. Such substantially reduces the assembly problems heretofore experienced regardless of the form of spring or resilient means employed. These relatively small pieces need not be handled and are held for mounting of the spring or band. With the embodiment of FIG. 2, the elastic strap is formed during the manufacturing process as an integral portion. Separate springs and the like are, therefore, eliminated. The only assembly with the preferred embodiment involves insertion of the slides 14 into the open ends of the main hanger body 12. Formation of an elastomer with an integral bond with a rigid portion of the hanger has significant advantages Time savings and cost savings are realized. Problems heretofore experienced are eliminated.

The hanger has use advantages over prior approaches. Slides 14 are pulled inwardly along the line of force generated by the spring elements Slide 14 has a longitudinal axis coincident with the longitudinal axis of body 12. The slides are guided by the body during retraction. Any tendency of the slides to cant within the body is substantially eliminated.

In view of the above description, those of ordinary skill in the art may envision various modifications which would not depart from the inventive concepts disclosed. It is expressly intended, therefore, that the above should be considered as only a description of the preferred embodiments. The true spirit and scope of the present invention may be determined by reference to the appended claims.

The embodiment of the invention in which an exclusive property or privilege is claimed as defined as follows:

1. An internal garment hanger adapted to retain a garment by a waistband, said hanger comprising:

an elongated body having front and back sidewalls and upper and lower beam-like members defining an open end, said body further defining a longitudinally extending slot opening through said front and back sidewalls;

an elongated slide having a garment engaging end and an opposite end which defines an aperature, said slide having an elongated slot, said slide extending into said open end of said body;

resilient means extending between said body and said opposite end of said slide and within said slot of said slide for resiliently biasing said slide out of said open end of said body; and stop means on said slide for stopping outward movement of the slide with respect to said body.

2. An internal garment hanger adapted to retain a garment by a waistband, said hanger comprising:

an elongated body defining an open end, said body further defining a longitudinally extending slot;

an elongated slide having a garment engaging end and an opposite end which defines an aperature, said slide having an elongated slot, said slide extending into said open end of said body;

resilient means extending between said body and said opposite end of said slide and within said slot of said slide for resiliently biasing said slide out of said open end of said body; and stop means on said slide for stopping outward movement of the slide with respect to said body, and wherein said resilient means comprises:

a cap operatively engaging said body at the open end of said body; and an elastomeric strap having an end permanently bonded to said slide and another end permanently bonded to said cap, so that said strap, said slide and said cap form an integral, unitary element.

3. An internal garment hanger as defined by claim 2 wherein said slide, said strap and said cap are injection molded with the strap molded under heat and pressure to form a permanent bond with the slide and cap.

4. An internal garment hanger as defined by claim 3 wherein said slide and said cap are molded from styrene and said strap is molded from a thermoplastic rubber.

5. An internal garment hanger as defined by claim 1 wherein said slide further includes an elastomeric pad bonded to an outer surface of said garment engaging end.

6. An internal garment hanger adapted to retain a garment by a waistband, said hanger comprising:

an elongated body defining an open end, said body further defining a longitudinally extending slot;

an elongated slide having a garment engaging end and an opposite end which defines an aperture, said slide having an elongated slot, said slide extending into said open end of said body;

resilient means extending between said body and said opposite end of said slide and within said slot of said slide for resiliently biasing said slide out of said open end of said body; and stop means on said slide for stopping outward movement of the slide with respect to said body, wherein said slide further including an elastomeric pad bonded to an outer surface of said garment engaging end, and wherein said resilient means comprises:

a cap; and an elastomeric strap having an end permanently bonded to said slide and another end permanently bonded to said cap, said cap operatively engaging said body at the open end of said body.

7. An internal garment hanger as defined by claim 6 wherein said slide, said strap and said cap are injection molded with the strap under heat and pressure to form a permanent bond with the slide and cap.

8. An internal garment hanger as defined by claim 7 wherein said slide and said cap are molded from styrene and said strap is molded from a thermoplastic rubber.

9. An internal garment hanger adapted to retain a garment by a waistband, said hanger comprising:

an elongated body defining an open end, said body further defining a longitudinally extending slot;

an elongated slide having a garment engaging end and an opposite end which defines an aperture, said slide having an elongated slot, said slide extending into said open end of said body;

resilient means extending between said body and said opposite end of said slide and within said slot of said slide for resiliently biasing said slide out of said open end of said body; and stop means on said slide for stopping outward movement of the slide with respect to said body, and wherein said resilient means comprises:

a cap, said cap being positioned within said slot of said slide and being joined to said slide by a severable bridge; and a spring having an end connected to said cap and an end connected to said slide, said cap dimensioned to be received within the open end of said body and wherein inward movement of the slide with respect to said body severs said bridge.

10. An internal garment hanger as defined by claim 9 wherein said spring comprises a coil spring having looped ends.

11. An internal garment hanger as defined by claim 9 wherein said spring comprises an elastomeric strap bonded to said cap and said slide.

12. A telescoping, internal garment hanger, comprising:

a main body having a central portion and elongated arms, said arms each defining an open end;

a pair of molded garment engaging slides, each slide being inserted into an open end of said main body;

a pair of caps, each cap being disposed within and operatively engaging said body at an open end of said body; and a pair of elastomeric straps, each strap having an end molded and bonded to one of said caps and an end molded and bonded to one of said slides.

13. A hanger as defined by claim 12 wherein said slides are molded from styrene and said straps are molded from a thermoplastic rubber.

14. A hanger as defined by claim 12 wherein said slides each define an elongated slot having a longitudinal axis coincident with a longitudinal axis of said main body.

15. A hanger as defined by claim 14 wherein said caps are each molded and joined to one of said slides with said slots by an integral, severable bridge piece.

16. A hanger as defined by claim 14 wherein each of said slides has an end defining an aperture and where said body defines an elongated opening exposing said aperature so that the slide may be grasped at said apertures.

17. A hanger as defined by claim 16 wherein said slides each define a garment engaging face and wherein each slides each include a pad of thermoplastic rubber molded and bonded to said face.

18. A garment hanger component, comprising:

a molded plastic body;

a molded plastic element; and an elastomeric member having an end integral with and bonded to said body and an end connected to said plastic element.

19. A garment hanger component as defined by claim 18 wherein said body and said element are molded from styrene and said member is molded from a thermoplastic rubber.

20. A garment hanger component as defined by claim 18 further including a severable bridge joining said body to said element

21. A garment hanger component as defined by claim 20 wherein said body and said element are molded from styrene and said member is molded from a thermoplastic rubber.

* * * * *

UNITED STATES PATENT AND TRADEMARK OFFICE
CERTIFICATE OF CORRECTION

PATENT NO. : 5,022,571

DATED : June 11, 1991

INVENTOR(S) : Russell O. Blanchard

It is certified that error appears in the above-identified patent and that said Letters Patent is hereby corrected as shown below:

Column 1, line 10;

"hanger" should be --hangers-- (first occurence).

Column 4, line 15;

Before "elastomeric" delete --15--.

Column 4, line 39;

"1 25" should be --125--.

Column 5, line 6;

After "advantages" insert --.--.

Column 5, line 11;

After "elements" insert --.--.

Column 5, line 24;

"embodiment" should be --embodiments--.

Column 5, line 25;

"claimed as" should be --claimed are--.

UNITED STATES PATENT AND TRADEMARK OFFICE

CERTIFICATE OF CORRECTION

PATENT NO. : 5,022,571

DATED : June 11, 1991

INVENTOR(S) : Russell O. Blanchard

It is certified that error appears in the above-identified patent and that said Letters Patent is hereby corrected as shown below:

Column 7, line 20;

"with" should be --within--.

Column 7, line 23;

"where" should be --wherein--.

Column 8, line 1;

"aperature" should be --aperture--.

Column 8, line 19, Claim 20;

After "element" insert --.--.

Signed and Sealed this

Twentieth Day of October, 1992

*Attest:*

DOUGLAS B. COMER

*Attesting Officer*

*Acting Commissioner of Patents and Trademarks*